United States Patent [19]

Konose

[11] Patent Number: 4,940,351

[45] Date of Patent: Jul. 10, 1990

[54] LIQUID APPLICATOR WITH MOVABLE SUPPLY TUBE

[75] Inventor: Yoshiomi Konose, Fujioka, Japan

[73] Assignee: Mitsubishi Pencil Co., Ltd., Tokyo, Japan

[21] Appl. No.: 381,234

[22] Filed: Jul. 18, 1989

[51] Int. Cl.[5] ..... A45D 34/00; A46B 11/00

[52] U.S. Cl. ..... 401/278; 401/273; 401/286; 401/288

[58] Field of Search ..... 401/288, 273, 272, 275, 401/278, 282, 286

[56] References Cited

U.S. PATENT DOCUMENTS 2,517,152 8/1950 Wilson ..... 401/273 X

FOREIGN PATENT DOCUMENTS 284166 9/1988 European Pat. Off. ..... 401/288

*Primary Examiner*—Steven A. Bratlie

*Attorney, Agent, or Firm*—Armstrong, Nikaido, Marmelstein, Kubovcik & Murray

[57] ABSTRACT

In a liquid applicator provided with a brush tuft for applying a high-viscosity liquid such as nail polish, the liquid is supplied to the brush tuft through a guide pipe a front half of which is axially slidably received in the brush tuft to make it possible that the liquid is supplied to an appropriate position in the vicinity of a tip portion of the brush tuft so as to improve application efficiency of the liquid.

1 Claim, 4 Drawing Sheets

LIQUID APPLICATOR WITH MOVABLE SUPPLY TUBE

BACKGROUND OF THE INVENTION

1. Field of the Invention

The present invention relates to a liquid applicator for applying liquids such as: cosmetic liquids such as nail polish; inks; paints; liquid drugs; and the like.

2. Description of the Prior Art

Heretofore, a number of liquid applicators of this type have been proposed, an example of which is shown in FIG. 4. This example or conventional liquid applicator shown in FIG. 4 is provided with an outer shaft or sleeve-like main body 4 in which is axially slidably mounted a cartridge 3 which is filled with an application liquid. In a front-end opening portion of the cartridge 3 is provided a valve unit 1, while a rear-end portion of the cartridge 3 extends rearward from a rear end of the outer shaft 4 to form a so-called push-out means of the cartridge 3. A front shaft 5 is threadably engaged with an outer peripheral surface of a front-end portion of the outer shaft 4 so that a brush tuft 6 serving as a liquid-application member of the applicator is fixedly mounted in the front shaft 5. On the other hand, an application-liquid conduit 8 is fixedly mounted on an inner surface of the front-end portion of the outer shaft 4, a rear-end portion of which conduit 8 is inserted into the interior of the cartridge 3 so as to abut on a valve stem 9 of the valve unit 1. With a front end of the conduit 8 is connected an application-liquid guide pipe 7 a front-end portion of which is inserted into the interior of the brush tuft 6. In operation of the conventional liquid applicator shown in FIG. 4, the cartridge 3 is pushed axially forward to move the valve stem 9 rearward relative to the cartridge 3 so as to open the valve unit 1. As a result, the application liquid contained in the cartridge 3 is permitted to flow to the brush tuft 6 through the conduit 8 and the guide pipe 7. Incidentally, after assembling of the liquid applicator, a front end of the application-liquid guide pipe 7 reaches a position slightly ahead of an axially 15 intermediate portion of the brush tuft 6 in the interior thereof.

In the conventional liquid applicator having the above construction, in case that the viscosity of the application liquid is high, it takes too much time for the application liquid to reach a tip portion of the brush tuft 6 after the application liquid is supplied to the intermediate portion of the brush tuft 6. This is a problem inherent in the conventional liquid applicator having the above construction. It is possible to resolve the above problem by inserting the application-liquid pipe 7 into the brush tuft 6 so as to reach a position in the vicinity of the tip portion of the brush tuft 6. However, in this case, there is another problem in that the thus further inserted guide pipe 7 considerably impairs the brush tuft 6 in flexibility in use.

SUMMARY OF THE INVENTION

It is an object of the present invention to provide a liquid applicator which enables a high-viscosity application liquid to immediately flow to a tip portion of a brush tuft or liquid-application member in use so as to improve application efficiency of the liquid.

In the liquid applicator of the present invention, at a time when the application liquid is supplied to the liquid-application member of the applicator, since an application-liquid guide pipe is axially moved forward to its extended position in the interior of the liquid-application member or brush tuft so as to immediately supply the application liquid to a tip portion of the application member, it is possible to increase an application speed of the liquid even when the viscosity of the application liquid is considerably high. During application operation of the liquid, the application-liquid guide pipe is retracted rearward from the above extended position in the interior of the application member so that there is no fear that the application-liquid guide pipe impairs the application efficiency of the liquid.

The above object of the present invention is accomplished by providing:

In a liquid applicator comprising: an outer sleeve-like main body; a liquid-application member mounted on a front-end portion of the outer sleeve-like main body; an application-liquid reservoir cartridge axially slidably mounted in the outer sleeve-like main body, the cartridge being provided with a valve unit in its front-end opening portion, the valve unit being provided with a valve spring for resiliently pressing a valve stem against a valve seat; a means for axially pushing the cartridge forward; an application-liquid conduit for supplying an application liquid filled in the cartridge to the liquid-application member through the valve unit, the conduit being provided in front of the cartridge mounted in the outer sleeve-like main body, a rear end of which conduit abuts on the valve unit; and an application-liquid guide pipe integrally connected with the application-liquid conduit to communicate therewith, a front-end portion of which guide pipe is inserted into the liquid-application member; whereby the cartridge is axially moved forward relative to the outer sleeve-like main body in use to open the valve unit so as to permit the application liquid to flow to the liquid-application member;

the improvement wherein:

the application-liquid conduit is axially movable by a predetermined distance together with the application-liquid guide pipe; and the liquid applicator further comprises a spring for resiliently pressing the application-liquid conduit against the valve stem of the valve unit, the spring being smaller in spring constant than the valve spring of the valve unit.

DESCRIPTION OF THE PREFERRED EMBODIMENT

Figure 1:
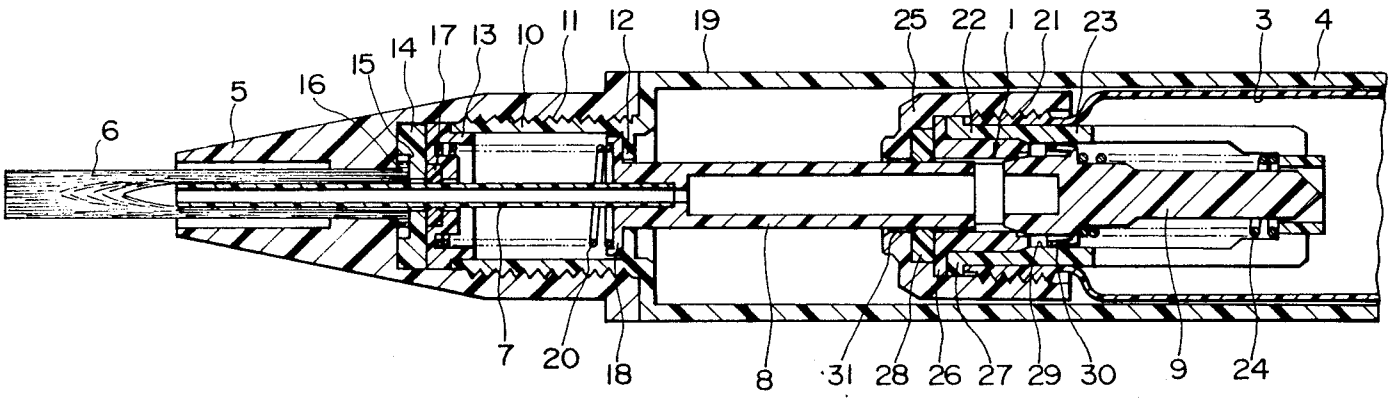
FIG. 1 is a longitudinal sectional view of an essentially part of a nail-polish applicator or liquid applicator of the present invention during non-use of the applicator.

Now, a preferred embodiment of a liquid applicator or nail-polish applicator of the present invention will be described hereinbelow in detail with reference to the accompanying drawings. The following embodiment is given for the purpose of illustration of the present invention and is not intended as limitation of the present invention.

In the drawings: the reference numeral 4 denotes an outer shaft or sleeve-like main body of the nail-polish applicator; 3 an application-liquid or nail polish reservoir cartridge axially slidably mounted in the outer shaft 4; 5 a front shaft threadably mounted on a front-end portion of the outer shaft 4; and 6 a brush tuft which serves as a liquid-application member of the applicator and may be replaced with one made of porous materials.

The outer shaft 4 is provided with a rear-end opening through which the cartridge 3 is inserted into the outer shaft 4 in assembling thereof. A front-end portion of the outer shaft 4 is smaller in diameter than the remaining portion of the outer shaft 4 to form a small-diameter portion 10 as shown in FIG. 1. An outer peripheral surface of the small-diameter portion 10 of the outer shaft 4 is provided with a male screw 11.

In a rear end of the small-diameter portion 10 of the outer shaft 4 is provided a radially inwardly extending flange 12.

In a front-end opening portion of the small-diameter portion 10 of the outer shaft 4 is mounted a spring bearing 13 which defines a closed chamber in the interior of the small-diameter portion 10 of the outer shaft 4.

The front shaft 5 is provided with a bore into which a rear half of the brush tuft 6 is inserted in assembling. In the interior of the front shaft 5 is so provided a sealing member 14 as to fixedly sandwich a rear-end flange portion 16 of the brush tuft 6 between a front concave portion 15 of the sealing member 14 and an inner wall surface of the front shaft 5, whereby the brush tuft 6 is fixedly mounted in the applicator. A rear surface of the sealing member 14 abuts on a front surface of the spring bearing 13. A packing member 17 is fixedly sandwiched between the sealing member 14 and the spring bearing 13.

In FIG. 1, the reference numeral 8 denotes an application-liquid conduit or nail-polish conduit which is provided with a radially outwardly extending flange portion 18 in its front end. The flange portion 18 of the conduit 8 is axially movably received in the closed chamber-of the small-diameter portion 10 of the outer shaft 5 and can travel from its rear position adjacent to the flange 12 to its front position adjacent to the spring bearing 13.

An outer diameter of the flange portion 18 of the conduit 8 is slightly smaller than an inner diameter of the small-diameter portion 10 of the outer shaft 5. Consequently, the flange portion 18 of the conduit 8 is prevented from axially moving beyond both of the flange 12 and the spring bearing 13. In other words, the flange portion 18 of the conduit 8 can axially move between the flange 12 and the spring bearing 13.

The application-liquid conduit 8 extends rearward from the small-diameter portion 10 of the outer shaft 5 so as to enter the remaining rear portion of the outer shaft 4. A rear end of the conduit 8 abuts on a front end of a valve stem 9 of a valve unit 1 provided in the cartridge 3.

Between the flange portion 18 of the conduit 8 and the spring bearing 13 is interposed a compression coil spring 20 for resiliently pressing the conduit 8 against the valve stem 9. The spring 20 is so constructed of a fine filament as to be smaller in spring constant than the valve spring 24.

An application-liquid guide pipe 7 is integrally connected with a front-end portion of the conduit 8 so as to communicate therewith. As is clear from FIG. 1, the guide pipe 7 passes through each of central portions of the spring bearing 13, packing member 17 and the sealing member 14 to enable its front-end portion to be axially movably received in the interior of the brush tuft 6.

The packing member 17 prevents the application liquid or nail polish from leaking from an outer peripheral surface of the guide pipe 7.

The cartridge 3 is filled with the application liquid or nail polish. A rear-end portion of the cartridge 3 extends rearward from a rear end of the outer shaft 4 to form a so-called push-out means for pushing the cartridge 3 forward relative to the outer shaft 4 in use.

A front-end portion of the cartridge 3 forms a small-diameter portion provided with a front-end opening in which is fixedly mounted the valve unit 1 which is constructed of a valve seat 22, a spring bearing 23, the valve stem 9 and the valve spring 24. A front piece 25 is threadably mounted on the front-end portion of the cartridge 3 so that the valve unit 1 is fixedly mounted in the cartridge 3. Another packing member 28 is interposed between the front piece 25 and the valve unit 1.

The cartridge 3 provided with the valve unit 1 is publicly known in its construction and operation.

The valve spring 24 is a relatively strong compression coil spring which is larger in spring constant than the coil spring 20 for pressing the conduit 8.

The spring bearing 23 is provided with a cylindrical portion 29 in its inner surface at a position slightly behind the valve seat 22. On the other hand, the valve stem 9 is provided with a flange-like piston portion 30 consisting of: a radially outwardly extending rear wall part; and an annular wall part axially extending forward from an end of the rear wall part of the piston portion 30. The annular wall part of the piston portion 30 of the valve stem 9 is brought into a slidable and a hermetical contact with the cylindrical portion 29 of the spring bearing 23.

A through-hole 31 is provided in a central portion of the front piece 25, through which through-hole 31 a rear-end portion of the application-liquid conduit 8 is inserted into the interior of the valve seat 22 so as to abut on a front end of the valve stem 9.

As shown in FIG. 1, when the cartridge 3 is not pushed forward by the user, the valve stem 9 is so pressed against the valve seat by the valve spring 24 as to close the valve unit 1. On the other hand, the application-liquid conduit 8 is so pressed by the coil spring 20 as to cause a back surface of the flange portion 18 thereof to abut on a front surface of the flange 12 of the outer shaft 4. The application-liquid guide pipe 7 has a predetermined length which enables the front end of the guide pipe 7 to reach an appropriate position in the vicinity of a tip portion of the brush tuft 6 at a time when the guide pipe 7 is axially moved forward to its front position.

Now, operation of the nail-polish applicator or liquid applicator of the present invention will be described hereinbelow in detail.

Figure 2:
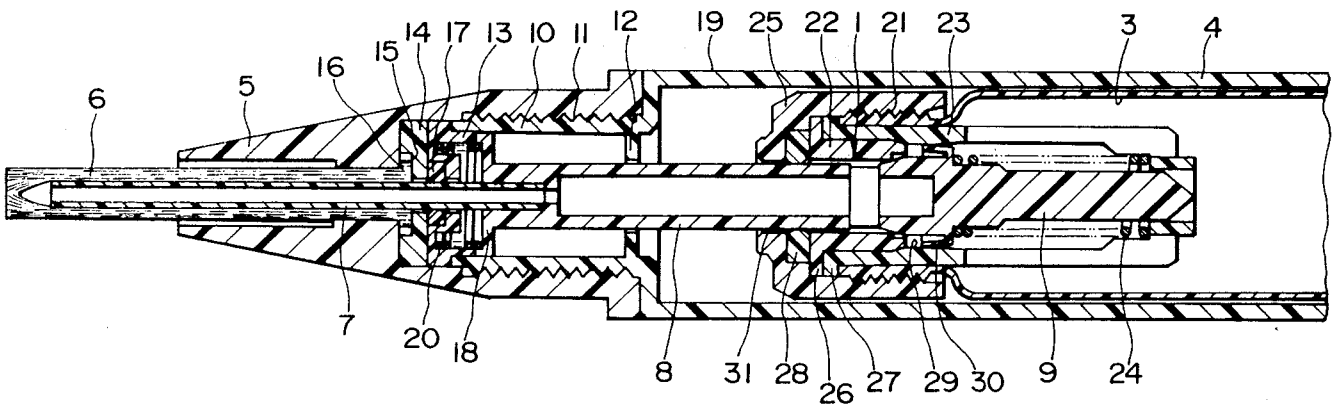
FIG. 2 is a view similar to FIG. 1 but showing the cartridge having been axially moved forward to its intermediate position.

In use, when the user pushes the rear end of the cartridge 3 axially forward relative to the outer shaft 4, the valve unit 1 is also axially moved forward relative to the outer shaft 4. As a result, the valve stem 9 pushes the rear end of the application-liquid conduit 8 axially forward to push the application-liquid guide pipe 7 axially forward against the resilient force exerted by the coil spring 20. At this time, since the valve spring 24 is larger in spring constant than the coil spring 20, the valve spring 24 is substantially not compressed in comparison with the coil spring 20. Under such circumstances, the pushing operation of the cartridge 3 is continued until the front flange portion 18 of the application-liquid conduit 8 is brought into contact with the rear end of the spring bearing 13. As shown in FIG. 2, when the flange portion 18 is brought into contact with the spring bearing 13, the front end of the application-liquid guide pipe 7 reaches the appropriate position in the vicinity of the tip portion of the brush tuft 6.

Figure 3:
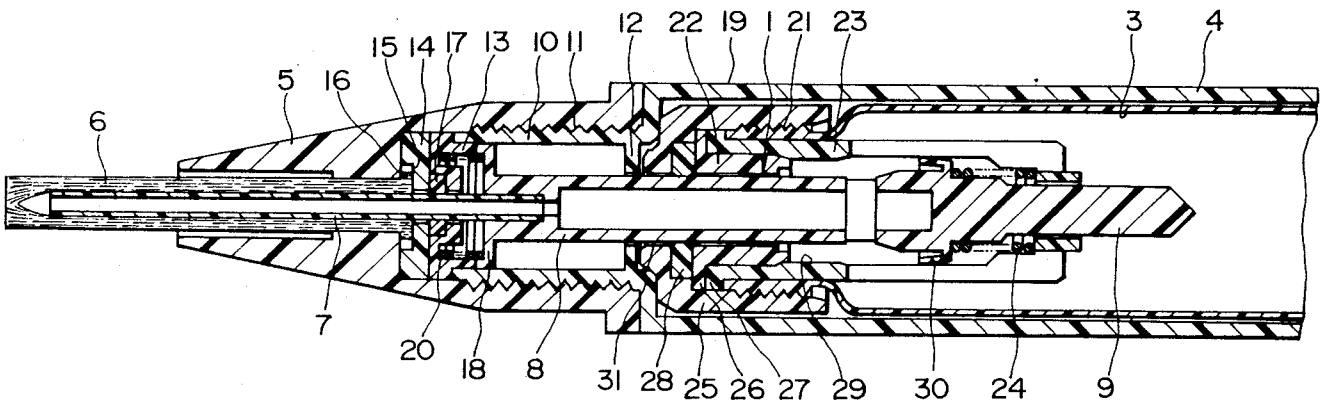
FIG. 3 is a view similar to FIG. 1 but showing the cartridge having been axially moved forward to its front position.
Figure 4:
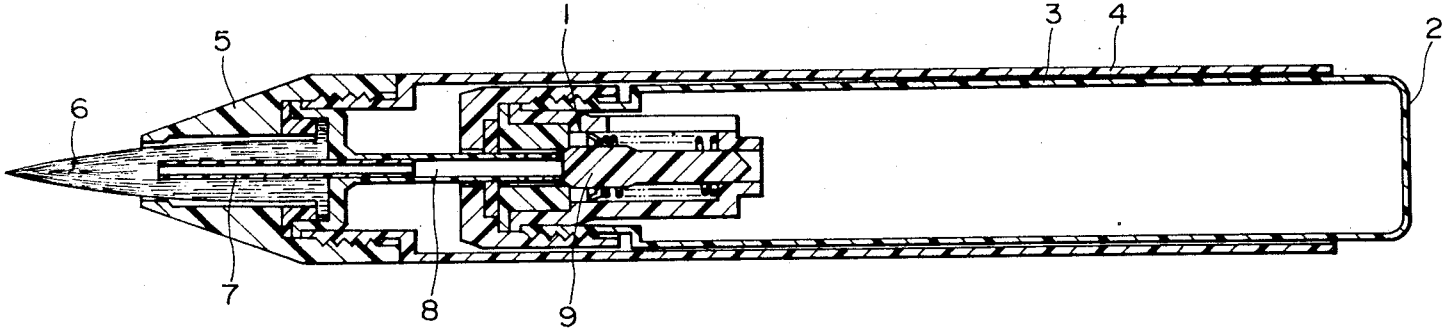
FIG. 4 PRIOR ART
FIG. 4 is a longitudinal sectional view of the conventional nail-polish applicator or liquid applicator.

When the cartridge 3 is further pushed by the user axially forward after the flange portion 18 of the application-liquid conduit 8 is brought into contact with the spring bearing 13, the valve spring 24 is compressed by the application-liquid conduit 8 having been prevented from being axially moved forward by the spring bearing 13, so that the valve stem 9 is axially moved rearward relative to the cartridge 3 to which is fixed the valve seat 22. As a result, as shown in FIG. 3, the valve stem 9 is separated from the valve seat 22 to cause the piston portion 30 of the valve stem 9 to be separated from the cylindrical portion 29 of the spring bearing 23, so that the application liquid filled in the cartridge 3 is allowed to flow into the cylindrical portion 29 of the spring bearing 23.

When the user releases the cartridge 3, the valve spring 24, which is larger in spring constant than the coil spring 20, is first expanded to move the valve stem 9 axially forward relative to the cartridge 3 so that the piston portion 30 of the valve stem 9 is brought into a slidable and a hermetical contact with the cylindrical portion 29 of the spring bearing 23, whereby the application liquid having been filled in the cylindrical portion 29 is forced to flow into the application-liquid conduit 8 through which the application liquid further flows into the guide pipe 7 so as to be supplied to the tip portion of the brush tuft 6. At this time, the coil spring 20, which is smaller in spring constant than the valve spring 24, substantially remains compressed until the valve spring 24 is expanded into its initial condition. Consequently, the application-liquid guide pipe 7 also substantially remains at its front position shown in FIGS. 2 and 3, to make it possible to supply the application liquid to the appropriate position in the vicinity of the tip portion of the brush tuft 6. After completion of expansion of the valve spring 24, the coil spring 20 begins to expand so that both the application-liquid conduit 8 and the guide pipe 7 are moved axially rearward to return to their initial positions shown in FIG. 1.

What is claimed is:

1. In a liquid applicator comprising: an outer sleeve-like main body; a liquid-application member mounted on a front-end portion of said outer sleeve-like main body; an application-liquid reservoir cartridge axially slidably mounted in said outer sleeve-like main body, said cartridge being provided with a valve unit in its front-end opening portion, said valve unit being provided with a valve spring for resiliently pressing a valve stem against a valve seat; a means for axially pushing said cartridge forward, an application-liquid conduit for supplying an application liquid filled in said cartridge to said liquid-application member through said valve unit, said conduit being provided in front of said cartridge mounted in said outer sleeve-like main body, a rear end of which conduit abuts on said valve unit; and an application-liquid guide pipe integrally connected with said application-liquid conduit to communicate therewith, a front-end portion of which guide pipe is inserted into said liquid-application member; whereby said cartridge is axially moved forward relative to said outer sleeve-like main body in use to open said valve unit so as to permit said application liquid to flow to said liquid-application member;

the improvement wherein:

said application-liquid conduit is axially movable by a predetermined distance together with said application-liquid guide pipe; and said liquid applicator further comprises a spring for resiliently pressing said application-liquid conduit against said valve stem of said valve unit, said spring being smaller in spring constant than said valve spring of the valve unit.

* * * * *